US006616001B2

(12) United States Patent
Saito et al.

(10) Patent No.: US 6,616,001 B2
(45) Date of Patent: Sep. 9, 2003

(54) BOTTLE-TYPE PLASTIC CONTAINER WITH REINFORCED VACUUM ABSORPTION PANEL IN GRIP REGION

(75) Inventors: Hiromichi Saito, Tokyo (JP); Takao Iizuka, Tokyo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 0 days.

(21) Appl. No.: 10/058,307

(22) Filed: Jan. 30, 2002

(65) Prior Publication Data

US 2002/0162819 A1 Nov. 7, 2002

(30) Foreign Application Priority Data

Jan. 31, 2001 (JP) ..... 2001-023140

(51) Int. Cl.[7] ..... B65D 1/42; B65D 23/10

(52) U.S. Cl. ..... 215/381; 215/382; 215/384; 220/669

(58) Field of Search ..... 215/379, 382, 215/384, 398, 381, 383; 220/721, 669; D9/530, 540–553

(56) References Cited

U.S. PATENT DOCUMENTS 4,804,097 A * 2/1989 Alberghini et al. ..... 215/384
4,805,788 A * 2/1989 Akiho ..... 215/382 X
5,165,557 A * 11/1992 Ota et al. ..... 215/384
5,381,910 A * 1/1995 Sugiura et al. ..... 215/398
5,392,937 A * 2/1995 Prevot et al. ..... 220/771 X
5,837,170 A * 11/1998 Valyi ..... 215/6 X
5,971,184 A * 10/1999 Krishnakumar et al. 220/771 X
D450,595 S * 11/2001 Ogg et al. ..... D9/540 X
D452,445 S * 12/2001 Silvers et al. ..... D9/540 X
D454,501 S * 3/2002 Tornaletti et al. ..... D9/541

FOREIGN PATENT DOCUMENTS

JP Y2 4-33238 8/1992
JP Y2 4-33239 8/1992

* cited by examiner

*Primary Examiner*—Sue A. Weaver
(74) *Attorney, Agent, or Firm*—Oliff & Berridge, PLC

(57) ABSTRACT

A bottle-type plastic container includes a container body and an opening at one end of the container body for allowing liquid contents to be charged into the container and discharged therefrom. The container body has surface portions, which are recessed inwards and opposed to each other to define a grip region therebetween. The grip region includes a panel portion for absorbing deformation of the container body upon pressure drop therein. The panel portion has a width as measured in circumferential direction of the container body, and is provided with at least one circumferential rib having a length that is smaller that the width of the panel portion.

19 Claims, 4 Drawing Sheets

BOTTLE-TYPE PLASTIC CONTAINER WITH REINFORCED VACUUM ABSORPTION PANEL IN GRIP REGION

BACKGROUND OF THE INVENTION

1. Field of Invention

The present invention relates a bottle-type plastic container having a container body that is partly recessed inwards to afford a grip region.

2. Description of Related Art

As a bottle-type container for beverages, alcoholic drinks, etc., a relatively large size plastic container is often used, having a capacity of 2,700 $cm^3$, for example, and produced by a biaxial orientation blow molding process or the like.

The body of such container is large and heavy in use, and is thus not always easy to stably hold by a single hand. Therefore, it has been a conventional practice to provide such a container with a separately prepared grip member that is fixedly secured to the body. However, provision of separate grip member is not very suitable solution from the viewpoint of reduction in production steps, cost and material. Furthermore, so-called separated collection of waste materials becomes difficult or time consuming, particularly when the body and the grip member are comprised of mutually different materials and, hence, the grip member has to be removed from the body before disposition.

These problems can be effectively eliminated by a pinch grip-type container including a body that is partly recessed inwards to afford a grip region, as disclosed, for example, in JP-4-33,238Y2 or JP-4-33,239Y2. In this instance, the container body has surface portions that are recessed inwards and opposed to each other to define a grip region therebetween, which is configured so as to be engaged by consumer's hand. Such an arrangement proved to be highly advantageous in that a plastic container with an integral grip region can be produced efficiently and at low cost, without requiring a separate grip member to be prepared in advance and subsequently connected to the container body.

On the other hand, however, there is a problem in that the pinch grip-type container of a large size tends to deform upon pressure drop in the container body, thereby deteriorating the appearance and commercial value of the goods.

For a bottle-type container of a small size, it is known to provide the container with a deformation absorbing panel in the container body. Thus, one may consider that the deformation absorbing panel can be applied to a container of a large size, in the rear surface portion of the container body, e.g., at the grip region thereof. However, in order to effectively absorb deformation of the container body, the deformation absorbing panel is generally made to have a small thickness. Therefor, provision of the deformation absorbing panel at the grip region of a container of a large size would result in difficulty in preserving the regidity and strength of the grip region and it would be thus difficult to stably bold the container by hand.

SUMMARY OF THE INVENTION

It is therefore an object of the present invention to provide an improved bottle-type plastic container, which eliminates the above-mentioned problems of the prior art, and which effectively absorbs deformation of the container body while allowing the container to be held stably by hand.

To this end, according to the present invention, a bottle-type plastic container comprises a container body and an opening at one end of the container body, for allowing liquid contents to be charged into the container and discharged therefrom. The container body has surface portions which are recessed inwards and opposed to each other to define a grip region therebetween. The grip region includes a panel portion for absorbing deformation of the container body upon pressure drop therein. The panel portion has a width as measured in circumferential direction of the container body. The panel portion is provided with at least one circumferential rib having a length that is smaller than the width of the panel portion.

With the above-mentioned arrangement of the bottle-type plastic container according to the present invention, the panel portion in the grip region of the container body serves to effectively absorb deformation of the container body upon pressure drop therein. Yet, the circumferential rib provided for the panel preserves the rigidity and strength of the grip region so that the container can be readily and stably held by hand.

It is preferred that the at least one rib in the panel portion is comprised of a ridge protruding outwards of the panel portion, or of a groove recessed inwards of the panel portion.

The container according to the present invention may have an inner volume within a range of 1,800–4,000 $cm^3$.

BRIEF DESCRIPTION OF THE DRAWINGS

The present invention will be explained below in further detail, with reference to a preferred embodiment shown in the drawings.

DETAILED DESCRIPTION OF THE PREFERRED EMBODIMENT

Figure 1:
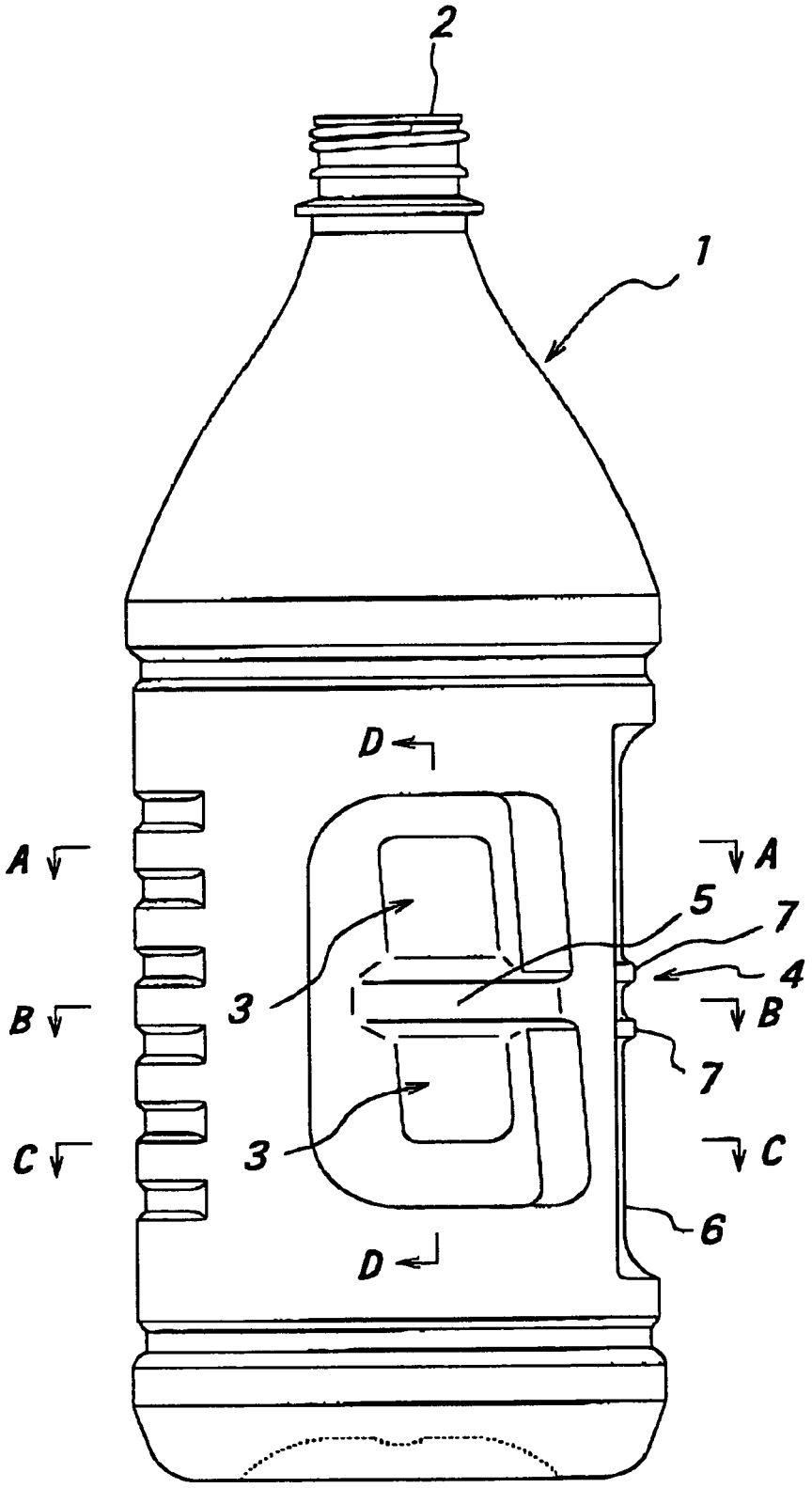
FIGS. 1 and 2 are side view and rear view, respectively, of the bottle-type plastic container according to one embodiment of the present invention.
Figure 2:
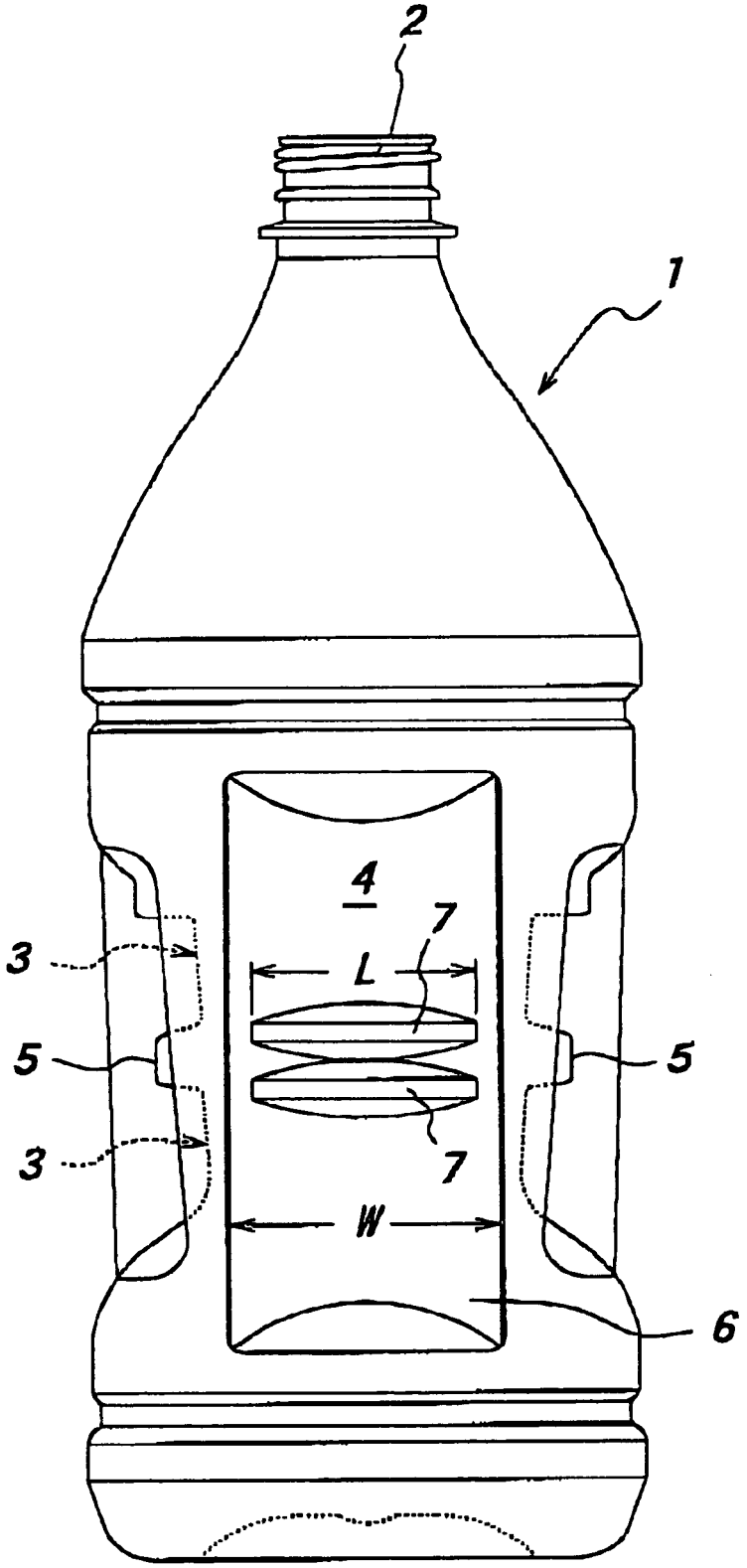
Figure 3A:
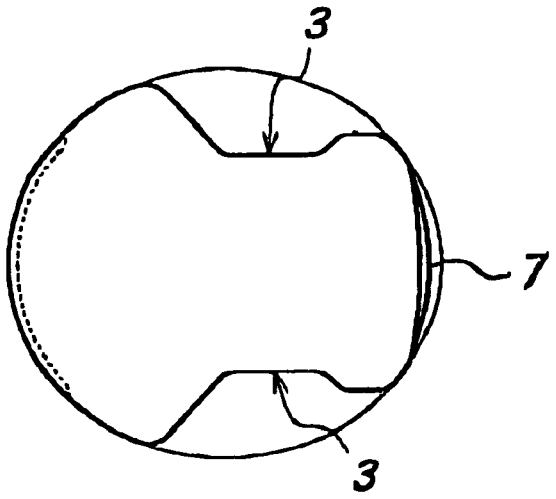
FIGS. 3*a*, 3*b* and 3*c* are schematic cross-sectional views taken along the lines A—A, B—B and C—C in FIG. 1, respectively.
Figure 3B:
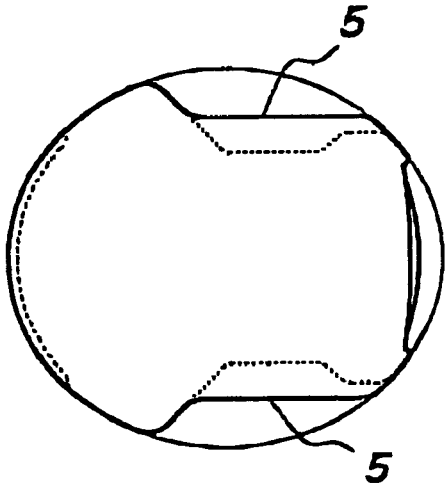
Figure 3C:
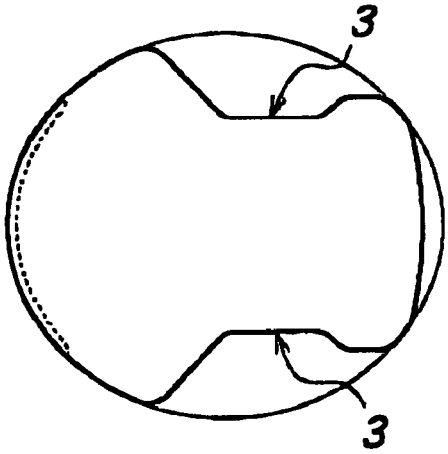
Figure 4:
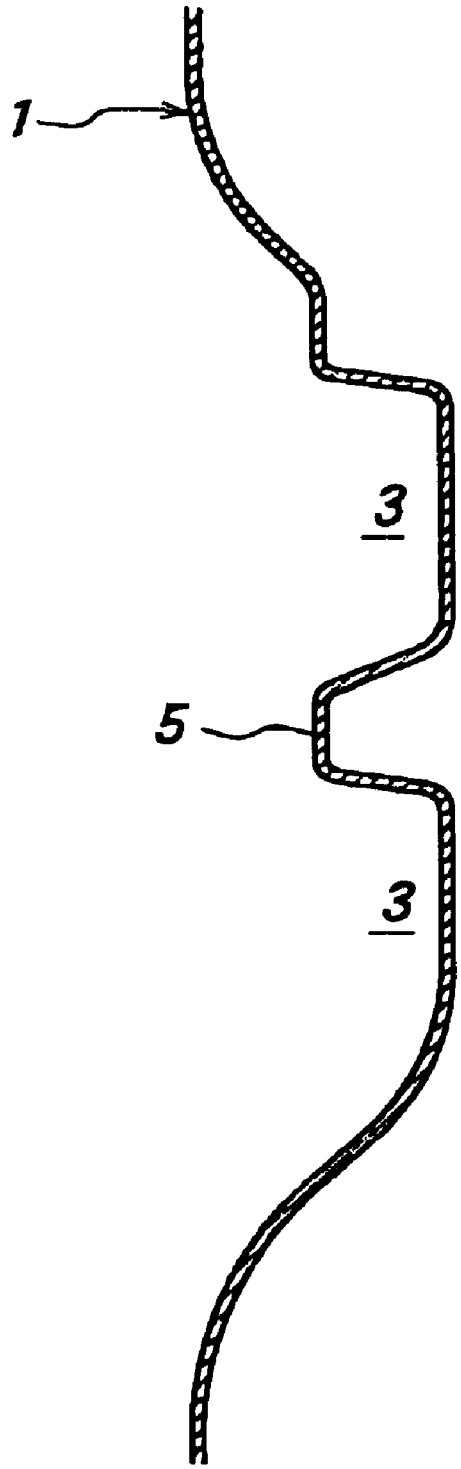
FIG. 4 is a schematic sectional view taken along the line D—D in FIG. 1.

Referring now to FIGS. 1 and 2, there is shown a bottle-type plastic container according to one embodiment of the present invention. The container includes a substantially cylindrical container body designated as a whole by reference numeral 1. An opening 2 is formed at an upper end region of the container body 1, for allowing the container to be filled with liquid contents and emptied therefrom. For the sake of convenience, it is assumed that the container has an inner volume of 2,700 $cm^3$.

The container according to the present invention may be made of an appropriate synthetic resin, typically a saturated polyester-type thermoplastic resin having a sufficient resistance to chemicals, such as polyethylene terephthalate (PET) resin, polybuthylene terephthalate resin or polyethylene naphthalate resin. The container may be formed by known molding processes, such as biaxial orientation blow molding process or direct blow molding process. The container may be made of a single layer of the above-mentioned resin, or three or five layers comprised of outer and inner layers of the above-mentioned resin with one or more barrier layers therebetween. In this instance, the barrier layers may be comprised of polyimide resin or ethylene vinyl alcohol copolymer (EVOH) resin. When the container is made of a single layer, it may be comprised of a blend of the above-mentioned polyester resin and the barrier resin.

The container body 1 includes front and rear surface portions, of which the front surface portion serves as an ornamental portion either in the form of a printed surface, or bearing a heat shrink label or the like, indicating visual information such as trademark or the like. On the other hand, as shown in FIG. 1 and FIGS. 3*a* to 3*c*, both sides of the rear surface portion of the container body 1 are recessed inwards to provide depressions 3 on opposite sides, for defining a grip region 4 therebetween. As can be appreciated from FIG. 2, the grip region 4 in the rear surface portion is in the form of a panel 6 that allows a limited deformation of the grip region 4 when being grasped by hand, or when the liquid content within the container is subjected to change in temperature.

At the middle of the depression 3, a reinforcing rib 5 is integrally provided to extend in the circumferential direction of the container body 1. Similarly, at the middle of the panel 6, two reinforcing ribs 7 are integrally provided to extend in the circumferential direction of the container body 1. These reinforcing ribs 5, 7 preserve the required rigidity and strength of the container body 1. The front surface portion of the container body may also be formed with reinforcements in the form of ribs or grooves, whenever necessary to provide further enhanced rigidity or strength of the container body 1.

It is assumed that the reinforcing ribs 7 in the panel 6 has a length L that is smaller than the width W of the panel 6. Preferably, the length L of the reinforcing rib 7 is approximately 5–20 mm smaller than the width W of the panel 6. The reinforcing rib 7 may be comprised of a ridge protruding outwards of the panel 6, or of a groove recessed inwards of the panel 6. It is preferred that the number of the reinforcing rib 7 in the panel is two, since an excessive number of the reinforcing rib 7 may result in tendency of disturbing the flexing movement of the panel 7 when it is desired to absorb deformation of the container body, whereas an insufficient number of the reinforcing rib may not result in the intended reinforcement of the panel 7.

Provision of the reinforcing ribs 7 in the panel 6 serves to preserve the required rigidity and strength of the panel that is think and flexible in itself. On the other hand, provision of the reinforcing rib 5 at the middle of the depression 3 not only serves the required rigidity and strength of the container body 1, but also forms a clear boundary between the relatively wide part and relatively narrow part of the grip region 4, for indicating by a finger touch as to which of these parts the consumer is going to grasp.

It will be appreciated from the foregoing description that the present invention provides an improved bottle-type plastic container, which effectively absorbs deformation of the container body while preserving the required rigidity and strength of the panel so as to allow the container to be held stably by hand.

While the present invention has been described above with reference to a specific embodiment, various changes and/or modifications may be made without departing from the scope of the invention as defined by the appended claims.

What is claimed is:

1. A bottle-type plastic container comprising a container body and an opening at one end of the container body, for allowing liquid contents to be charged into the container and discharged therefrom, said container body having two surface portions which are recessed inwards and opposed to each other, a front surface portion extending between the two recessed surface portions, and a rear surface portion defining a grip region between the two opposed surface portions, wherein the grip region includes a panel portion for absorbing deformation of the container body upon pressure drop therein and the front surface portion is devoid of a panel portion for absorbing deformation, said panel portion of the grip region having a width as measured in circumferential direction of the container body, said panel portion being provided with at least one circumferential rib having a length that is smaller that the width of the panel portion.

2. The bottle-type plastic container according to claim 1, wherein said at least one circumferential rib is comprised of a ridge protruding outwards of the panel portion.

3. The bottle-type plastic container according to claim 1, wherein said at least one circumferential rib is comprised of a groove recessed inwards of the panel portion.

4. The bottle-type plastic container according to claim 1, wherein said container has an inner volume within a range of 1,800–4,000 $cm^3$.

5. The bottle-type container according to claim 1, wherein said at least one circumferential rib is centered at an axial midpoint of the panel portion.

6. The bottle-type container according to claim 1, wherein two circumferential ribs are centered at an axial midpoint of the panel portion.

7. The bottle-type container according to claim 1, wherein the length of the at least one circumferential rib is between 5–20 mm smaller that the width of the panel portion.

8. A bottle-type plastic container comprising a container body and an opening at one end of the container body, for allowing liquid contents to be charged into the container and discharged therefrom, said container body having surface portions which are recessed inwards and opposed to each other to define opposed depressions, a circumferentially extending reinforcing rib being provided at a predefined axial position within each depression to divide each depression into an upper and a lower portion, and a grip region defined between the opposed depressions, wherein the grip region includes a panel portion for absorbing deformation of the container body upon pressure drop therein, said panel portion having a width as measured in circumferential direction of the container body and being provided with at least one circumferential rib having a length that is smaller that the width of the panel portion, said at least one circumferential rib of said panel portion being provided at substantially the same predefined axial position as that of the circumferentially extending reinforcing ribs so that said at least one circumferential rib reinforces the panel portion during grasping of the container in the grip region during use and when liquid content within the container is subjected to a temperature change.

9. The bottle-type container according to claim 8, wherein said at least one circumferential rib is centered at an axial midpoint of the panel portion.

10. The bottle-type container according to claim 8, wherein two circumferential ribs are centered at an axial midpoint of the panel portion.

11. The bottle-type container according to claim 8, wherein the length of the at least one circumferential rib is between 5–20 mm smaller that the width of the panel portion.

12. The bottle-type container according to claim 8, wherein said at least one circumferential rib is comprised of a ridge protruding outwards of the panel portion.

13. The bottle-type container according to claim 8, wherein said at least one circumferential rib is comprised of a groove recessed inwards of the panel portion.

14. A bottle-type plastic container comprising a container body and an opening at one end of the container body, for allowing liquid contents to be charged into the container and discharged therefrom, said container body having two surface portions which are recessed inwards and opposed to each other to define depressions, a front surface portion extending between the two recessed surface portions, and a rear surface portion defining a rear grip region between the two opposed surface portions, a circumferentially extending reinforcing rib being provided at a predefined axial position within each depression to divide each depression into an upper and a lower portion, wherein the rear grip region includes a panel portion for absorbing deformation of the container body upon pressure drop therein, said panel portion having a width as measured in circumferential direction of the container body and being provided with at least one circumferential rib having a length that is smaller that the width of the panel portion, said at least one circumferential rib of said panel portion being provided at substantially the same predefined axial position as that of the circumferentially extending reinforcing ribs so that said at least one circumferential rib reinforces the panel portion during grasping of the container in the grip region during use and when liquid content within the container is subjected to a temperature change, the front surface portion being devoid of a panel portion for absorbing deformation.

15. The bottle-type container according to claim 14, wherein said at least one circumferential rib is centered at an axial midpoint of the panel portion.

16. The bottle-type container according to claim 14, wherein two circumferential ribs are centered at an axial midpoint of the panel portion.

17. The bottle-type container according to claim 14, wherein the length of the at least one circumferential rib is between 5–20 mm smaller that the width of the panel portion.

18. The bottle-type container according to claim 14, wherein said at least one circumferential rib is comprised of a ridge protruding outwards of the panel portion.

19. The bottle-type container according to claim 14, wherein said at least one circumferential rib is comprised of a groove recessed inwards of the panel portion.

* * * * *